US006080007A

United States Patent [19]

Dupuis et al.

[11] Patent Number: 6,080,007

[45] Date of Patent: Jun. 27, 2000

[54] COMMUNICATION CONNECTOR WITH WIRE HOLDING SLED

[75] Inventors: Joseph E. Dupuis, Mystic; John J. Milner, Milford; Richard A. Fazio, Deep River; Robert A. Aekins, Branford, all of Conn.; Karl Mortensen, Wakefield, R.I.

[73] Assignee: Hubbell Incorporated, Orange, Conn.

[21] Appl. No.: 09/201,141

[22] Filed: Nov. 30, 1998

(Under 37 CFR 1.47)

[51] Int. Cl.[7] ..... H01R 4/24

[52] U.S. Cl. ..... 439/418; 439/941; 439/676

[58] Field of Search ..... 439/418, 404, 439/344, 460, 676, 941

[56] References Cited

U.S. PATENT DOCUMENTS

| | | | |
|---|---|---|---|
| 5,414,393 | 5/1995 | Rose et al. | 439/676 |
| 5,432,484 | 7/1995 | Klas et al. | 439/676 |
| 5,571,035 | 11/1996 | Ferrill | 439/676 |
| 5,628,647 | 5/1997 | Rohrbaugh et al. | 439/404 |
| 5,830,005 | 11/1998 | Watanabe | 439/418 |
| 5,888,100 | 3/1999 | Bofill et al. | 439/676 |
| 5,899,770 | 5/1999 | Ezawa | 439/418 |

*Primary Examiner*—Paula Bradley
*Assistant Examiner*—Tho D. Ta
*Attorney, Agent, or Firm*—Jerry M. Presson; Mark S. Bicks; Alfred N. Goodman

[57] ABSTRACT

A connector for communication systems includes a housing, a plurality of insulation displacement contacts, and front and rear sleds. The housing has front and rear ends and an internal chamber opening on the rear end and defined by housing walls. A plurality of slots extend through one housing wall adjacent its front end. The insulation displacement contacts are mounted in the slots for movement between retracted positions spaced from the chamber and inserted positions extending into the chamber. The front sled is located in the internal chamber adjacent the front end, and has front sled walls defining axial passages through it. Lateral openings extend through one of the front sled walls into the axial passages and are aligned with the slots and the contacts in the housing. The rear sled is located in the internal chamber adjacent the rear end, and has at least four entry ports on its outer end arranged in first ordered array, four exit ports on its inner end arranged in a second ordered array and four conduits extending between the respective entry and exit ports. The second and third conduits are in relatively close proximity and cross over each other between the entry and exit ports.

25 Claims, 7 Drawing Sheets

Fig. 3
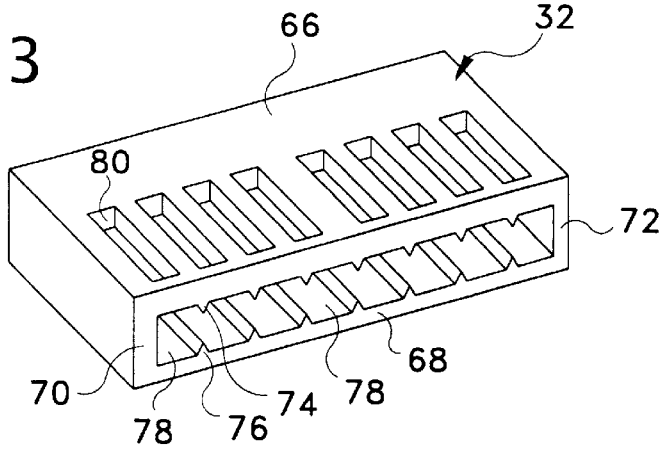
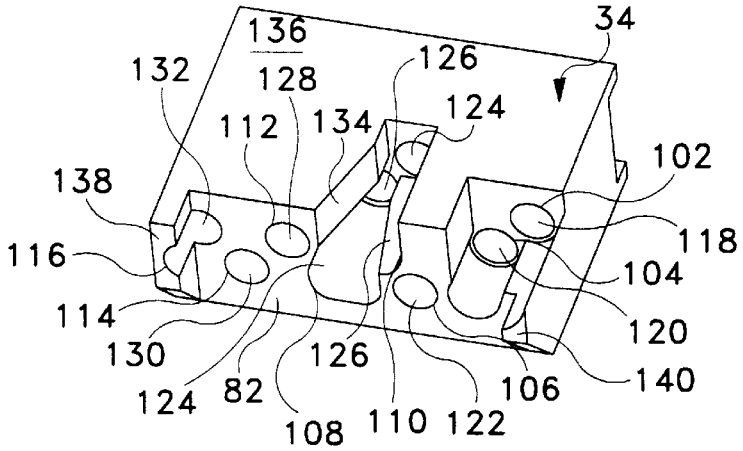
Fig. 4
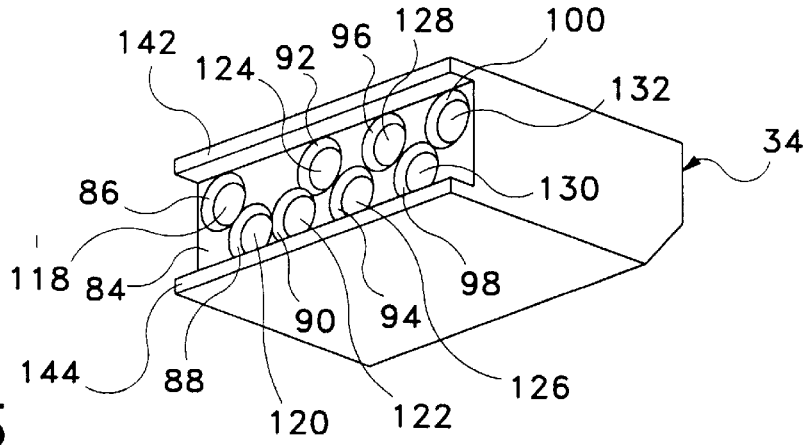
Fig. 5

Fig. 6
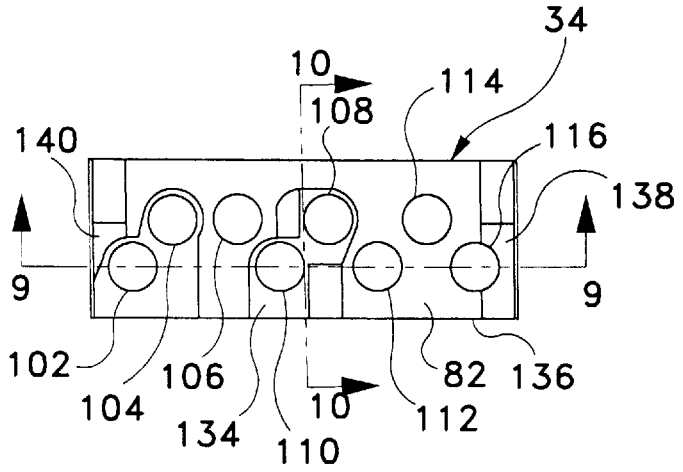
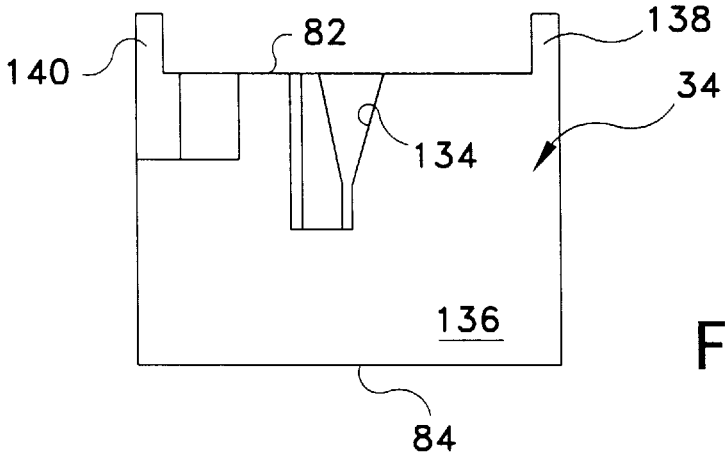
Fig. 7
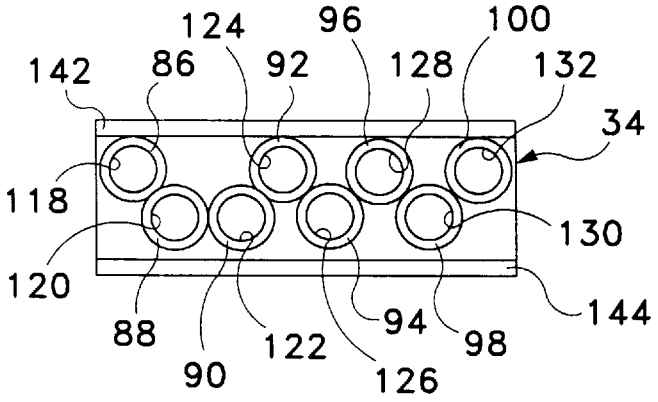
Fig. 8

Fig. 12
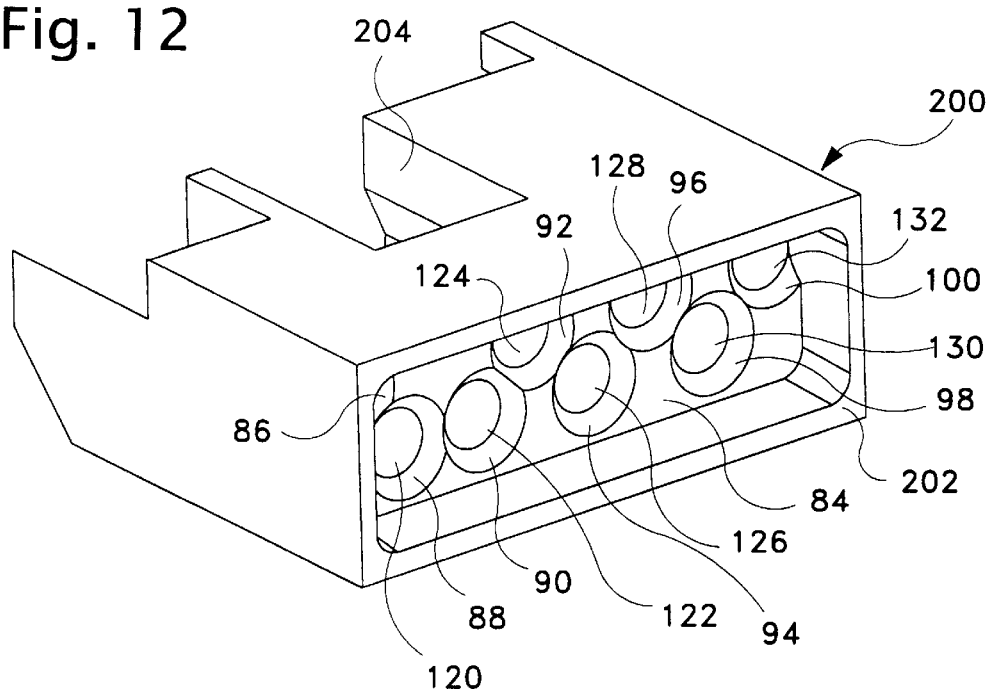
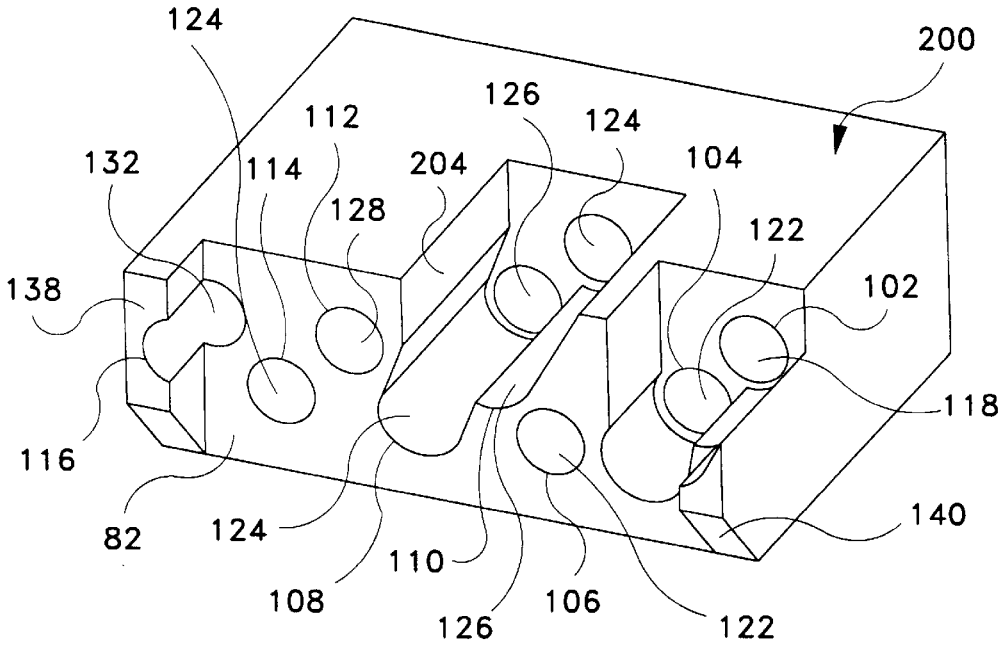
Fig. 13

COMMUNICATION CONNECTOR WITH WIRE HOLDING SLED

FIELD OF THE INVENTION

The present invention relates to a communication connector with a wire holding sled for retaining the cable wires in place in a constant, predetermined orientation inside the connector. More particularly, the constant predetermined orientation reduces crosstalk and locates the wires for connection to insulation displacement contacts in the connector housing.

BACKGROUND OF THE INVENTION

In telecommunication systems, signals are transmitted over cables having unshielded twisted pairs of wires. Typical cables have four pairs of twisted wires in them. For connecting wires to other cables or to other apparatus, connectors are mounted on the ends of the cables. These connectors are typically mounted in the field after the cables and wires therein are cut to the appropriate length for the particular installation.

Due to advances in telecommunications and data transmissions, connectors, particularly including plugs, have become a critical impediment to good performance of data transmission at new, higher frequencies. Some performance characteristics, particularly near end crosstalk and return loss, degrade beyond acceptable levels at these higher frequencies.

Performance requirements for conductive pathways are set forth in ANSI/TIA/EIA-568-A, "Commercial Building Telecommunications Cabling Standard". In the Category 6 Draft-Addendum in that standard, the minimum acceptable performance values are 54 dB at 100 MHz, 48 dB at 200/MHz and 46 dB at 250 MHz.

Additionally, in communications systems certain standards have been developed which define connector geometry and pin out definitions. These standards were created prior to the need for high speed data communications, and have created a large installed base of wiring connectors. Additionally, these standards have created a need for connectors capable of maintaining the requirements of higher speed communications, while maintaining compatibility with original connectors.

The standard connector geometry and pin outs can generate a great deal of crosstalk at higher signal frequencies. Connectors addressing this problem include U.S. Pat. No. 5,432,484 to Klas et al and U.S. Pat. No. 5,414,393 to Rose et al, this subject matters of which are hereby incorporated by reference.

In addition to the crosstalk reduction provided by the inventions of the above cited patents, crosstalk generated at the connection between the cable wires and the connectors, particularly the plug connectors has become significant. Variations in the placement of the wiring creates a varying amounts of crosstalk. Additionally, the wires must be accurately and precisely located within the connector to facilitate termination by the insulation displacement contacts.

SUMMARY OF THE INVENTION

At object of the present invention is to provide a connector for communication systems or a kit for making such connector which will reduce crosstalk by canceling crosstalk induced between the wiring and the connector.

Another object of the present invention is to provide a connector for communication systems or a kit for making such connector without net crosstalk in cable wiring termination, without providing shielding and without changing the standard connector geometry and pin out definitions.

A further object of the present invention is to provide a connector and a kit for making a connector without crosstalk which is simple and inexpensive to manufacture and to install on cables.

The foregoing objects are basically obtained by a connector for communication systems, comprising a housing, a plurality of insulation displacement contacts, and front and rear sleds. The housing has front and rear ends and an internal chamber opening on the rear end and defined by housing walls. A plurality of slots extend through one housing wall adjacent its front end. The insulation displacement contacts are mounted in the slots for movement between retracted positions spaced from the chamber and inserted positions extending into the chamber. The front sled is located in the internal chamber adjacent the front end, and has front sled walls defining axial passages through it. Lateral openings extend through one of the front sled walls into the axial passages and are aligned with the slots and the contacts in the housing. The rear sled is located in the internal chamber adjacent the rear end, and has at least four entry ports on its outer end arranged in first ordered array, four exit ports on its inner end arranged in a second ordered array and four conduits extending between the respective entry and exit ports. The second and third conduits are in relatively close proximity and cross over each other between the entry and exit ports.

The invention is also basically obtained by a kit for making a communication system connector comprising a housing, a plurality of insulation displacing contacts, and front and rear sleds. The housing has front and rear ends, an internal chamber opening on the rear end and defined by housing walls, and a plurality of slots extending through one of the walls adjacent its front end. The insulation piercing contacts are adapted to be mounted in the housing slots for movement between retracted positions spaced from the chamber and inserted positions extending into the chamber. The front sled is adapted to be located in the internal chamber adjacent the housing front end, and defines axial passageways through it. Lateral openings extend through one of the front sled walls into the axial passages and can be aligned with the slots and contacts in the housing. The rear sled is adapted to be located in the internal chamber adjacent the housing rear end, and has four entry ports on its outer end arranged in the first ordered array, four exit ports on its inner end arranged in a second ordered array and four conduits extending between the respective and entry ports. The second and third conduits are in relatively close proximity and cross over each other between its entry and exit ports.

By forming the connector and kit in this manner, crosstalk is countered without requiring new equipment and wiring. By locating the wiring in the conduits, the wiring will cancel the crosstalk induced thereby, regardless of whether the induced crosstalk results from an inductive coupling by means of magnetic fields or from a capacitive coupling by means of electric fields, or from a combination of both couplings, and will improve return loss. The strain relief for the terminated wires is also enhanced.

The crosstalk noise is eliminated, for example, by the energy induced onto the second wire from the first wire being approximately cancelled by coupling energy onto the second wire from the third wire in close proximity to the second wire and carrying a signal equal to but opposite to the signal in the first wire. This operation can be accomplished by crossing the second and third wires relative to the locations of the first and fourth wires.

Additionally, by locating the wires in the conduits, a relatively fixed, predetermined orientation is provided for the wires, providing substantially uniform and predetermined electrical properties or characteristics. Additionally, the wires are precisely located to facilitate termination with the insulation displacement contacts.

Other objects, advantages and salient features of the present invention will become apparent from the following detailed description, which, taken in conjunction with the annex drawings, discloses preferred embodiments of the present invention.

BRIEF DESCRIPTION OF THE DRAWINGS

Referring to the drawings which form a part of this disclosure:

FIG. 3 is a perspective view of a front sled of the connector of FIG. 1;

FIG. 4 is a front perspective view of a rear sled for the connector of FIG. 1 according to a first embodiment of the present invention;

FIG. 5 is a rear perspective view of the rear sled of FIG. 4;

FIG. 6 is a front elevational view of the rear sled of FIG. 4;

FIG. 7 is a top plan view of the rear sled of FIG. 4;

FIG. 8 is a rear end elevational view of the rear sled of FIG. 4;

FIG. 12 is a rear perspective view of a rear sled according to a second embodiment of the present invention;

FIG. 13 is a front perspective view of the rear sled of FIG. 12;

DETAILED DESCRIPTION OF THE INVENTION

Figure 1:
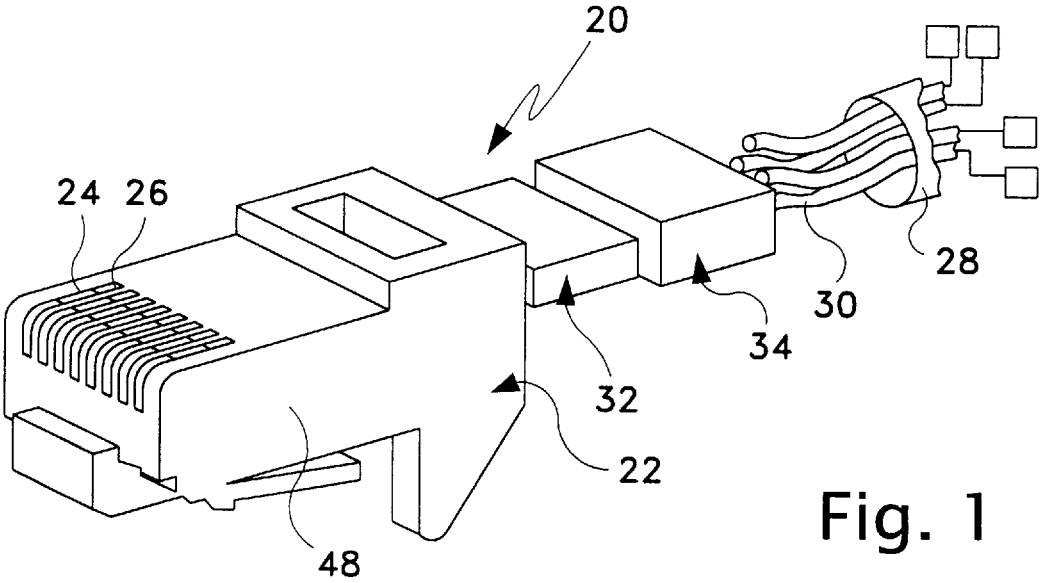
FIG. 1 is a diagrammatic, exploded perspective view of a connector with a cable to be coupled thereto according to the present invention.

Referring initially to FIG. 1, the basic components of the connector, according to the present invention, in the form of a plug 20 are illustrated. Plug 20 comprises a plug housing 22 with insulation displacement contacts 24 moveably mounted in housing slots 26. A cable 28 with four twisted pairs of wires 30 is mounted in plug housing 22 for mechanical and electrical connection of the individual wires 30 to the respective insulation displacement contacts 24.

Prior to being located within the plug housing, the eight wires are mounted within a front sled 32 and a rear sled 34. The front sled orients the eight wires in position for coupling to the eight insulation displacement contacts. The rear sled orients the eight wires for crosstalk reduction, return loss improvement and constant electrical characteristics. After the wiring is located and positioned within the two sleds, the two sleds are slid into plug housing 22 for assembly of the plug connector and termination of the wires by movement of the contacts into mechanical and electrical connection with the wires.

Figure 2:
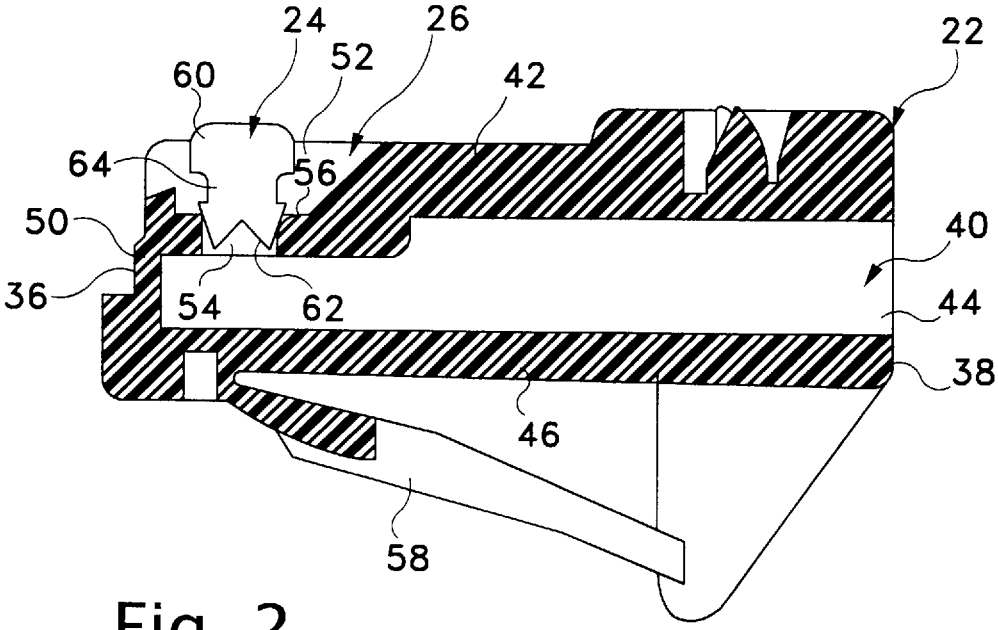
FIG. 2 is a side elevational view of a plug housing of the connector of FIG. 1.
Figure 9:
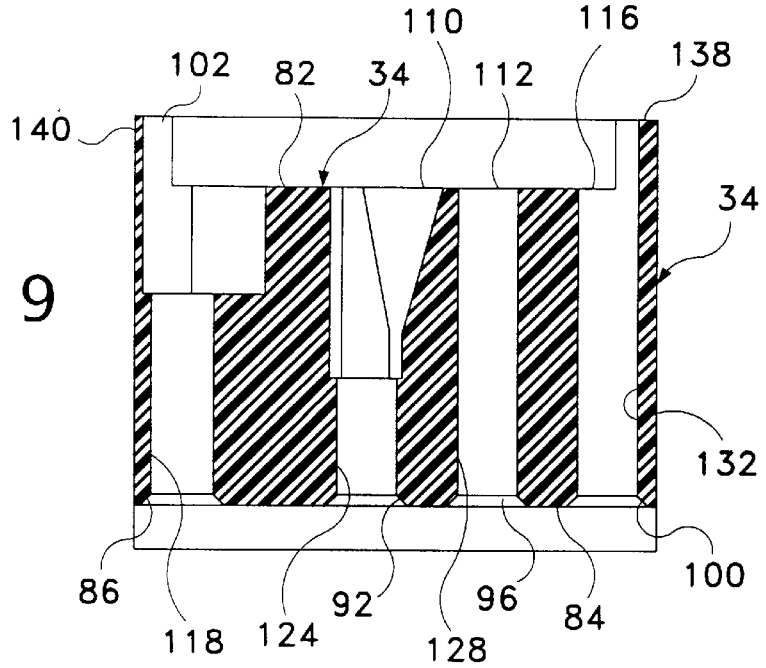
FIG. 9 is a top plan view in section taken along line 9—9 of FIG. 6.

Plug housing 22, as illustrated in FIGS. 1 and 2, has a front end 36 and a rear end 38. An internal chamber 40 opens on the housing rear end 38 and is defined by housing walls 42, 44, 46, 48 and 50. Slots 26 extend through housing wall 42, adjacent front end 36, and into chamber 40. Each slot has a outer section 52 and a narrower inner section 54. A shoulder 56 is located in the slot outer section at the point at which it joins inner section 54. The outer configuration of the plug housing and the positions of contacts 24 in slots 26 conform to standard connector geometry and pin out definition for communication systems.

Internal chamber 40 is relatively wider adjacent rear end 38 and relatively narrower adjacent front end 36. In cross section, each of the two portions of the internal chamber are rectangular in transverse cross section.

A conventional latch 58 is pivotally connected to housing wall 46. Since this latch is conventional, it is not described in further detail.

Each of the insulation displacement contacts 24 has a head end 60, a pointed and 62 and a connecting portion 64 between the head end and the pointed end. Prior to assembly, each contact is in the retracted position illustrated in FIG. 2 with its pointed end out of internal chamber 40. After the cable wires mounted in the sleds are inserted within the internal chamber, each of the contacts can be moved to its inserted position downwardly such that the pointed end engages and makes mechanical and electrical contact with the conductors in the insulated wires. In the inserted position, the lower section of head end 60 engages shoulder 56.

Front sled 32, as illustrated in FIG. 3, is generally in the configuration of a rectangular parallelepiped which is hollow. The front sled is formed by a top wall 66, a bottom wall 68, and side walls 70 and 72 which extend between and connect the top and bottom walls. The top wall has depending triangular top ridges 74 tapering downwardly and extending inwardly into the hollow interior of the front sled. The bottom wall has mirror image, inwardly extending, triangular bottom ridges 76 tapering upwardly. Each of the top ridges 74 is aligned with a respective bottom ridge 76. The ridges, along with the side wall 70 and 72, define eight axial passages extending entirely through the front sled for the eight wires in the cable.

Rectangular lateral openings 80 are provided in top wall 66. Each of the openings is centered over and is aligned with one of the passages 78, and extends entirely through top wall 66 to provide access to the interior of passages 78 through the openings.

When the front sled is mounted in plug housing 22, sled side walls 70 and 72 are located between and in contact with housing walls 44 and 48, with the front end of front sled 32 engaging housing wall 50, such that each of openings 80 is aligned with one of the contact slots 26. In this manner, the contacts, when moved to their inserted positions, pass through the openings to engage a wire held within the respective passage 78. The dimensions of the passages correspond with the wires such that one wire is retained and precisely located within each passage.

Rear sled 34 is illustrated in FIGS. 4–10, and has a front or inner end 82 which is to be located adjacent front sled 32 in plug housing chamber 40 and a rear or outer end 84 to be located adjacent plug housing rear end 38. Rear end 84 has eight inwardly tapered entry ports 86, 88, 90, 92, 94, 96, 98 and 100. The entry ports are arranged in a first ordered array. Of particular significance is the center four entry ports, i.e., positions 3 and 6 formed by ports 90 and 96 and positions 4 and 5 provided by ports 92 and 94, respectively. For these four ports in the first ordered array, ports 92 and 94 are between ports 90 and 96, with port 90 being adjacent port 92 and port 94 adjacent port 96. Entry ports 86, 92, 96 and 100 are in a first horizontal row. Entry ports 88, 90, 94 and 98 are in a second horizontal row. The two rows are parallel and are vertically spaced.

The front or inner end 82 of rear sled 34 has eight exit ports 102, 104, 106, 110, 108, 112, 114 and 116. These exit ports are arranged in a second ordered array. Ports 106, 110, 108 and 112 are particularly significant in the arrangement, with ports 108 and 110 being arranged between ports 106 and 112 and with port 110 adjacent port 106 and port 108 adjacent port 112.

Conduits 118, 120, 122, 124, 126, 128, 130 and 132 extend through the rear sled to connect the respective entry ports and exit ports. Specifically, conduit 118 couples entry port 86 to exit port 102; conduit 120 couples entry port 88 to exit port 104; conduit 122 couples entry 90 to exit port 106; conduit 124 couples entry port 92 to entry port 108; conduit 126 couples entry port 94 to exit port 110; conduit 128 couples entry port 96 to exit port 112; conduit 130 couples entry port 98 to exit port 114; and conduit 132 couples entry port 100 to exit port 116.

Each of conduits 118, 120, 122, 128, 130 and 132 extend parallel to each other along their entire lengths between their respective entry and exit ports. However, conduits 124 and 126 only extend in parallel relationship with other conduits along only a portion of their lengths adjacent rear or outer end 84. At approximately the mid-axial lengths point of the conduits, conduits 124 and 126 are laterally open into each other and are in relatively close proximity and cross over each other, such that the conduits in essence reverse positions. At this point, conduit 124 is adjacent conduit 128 and conduit 126 is adjacent 122 at inner or front end 82. In contrast, at rear or outer end 84, conduit 124 is adjacent conduit 122 and conduit 126 is adjacent 128.

A transverse passage 134 extends through surface 136. The transverse passage extends inwardly and opens into conduits 124 and 126 from their merging point (mid point) to the inner or front end 82 of rear sled 34. One side of the transverse passage is straight and parallel to the sled axis, while the opposite side is angled relative to the sled axis to taper the passage in a direction from the inner end to the outer end of the rear sled. At the front end of the rear sled, the passage has a width substantially equal to the total width of exit ports 108 and 110 and the lateral spacing therebetween. At its end remote from sled front end 82, the transverse passage has a width substantially equal to and vertically aligned with conduit 124 and laterally offset from conduit 126. The arrangement of the transverse passage and conduits 124 and 126 facilitates the threading and the cross over of the wires through the rear sled for entry in the appropriate passage 78 in front sled 32.

Spacing tabs 138 and 140 extend forwardly from each side of the rear sled front end and are tapered forwardly. These spacing tabs are intended to engage the rear or outer end of front sled 32 to control the separation between the two sleds upon insertion into the plug housing. This separation is critical in that it directly impacts the balanced inductive coupling across the device.

The rear or outer surface 84 of rear sled 34 is provided with parallel flanges 142 and 144. These flanges extend from the surface of the rear sled in which the entry ports are formed.

Figure 11:
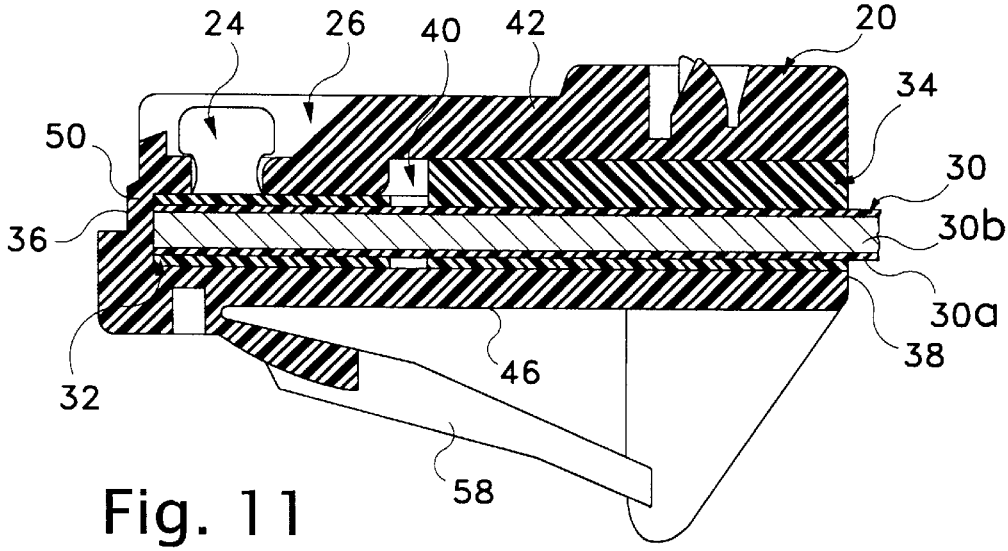
FIG. 11 is a side elevational view in section of the connector of FIG. 1 after being assembled.
Figure 10:
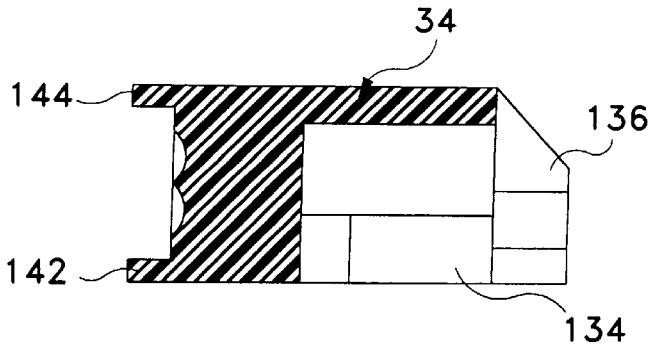
FIG. 10 is a side elevational view in section taken along line 10—10 of FIG. 6.
Figure 14:
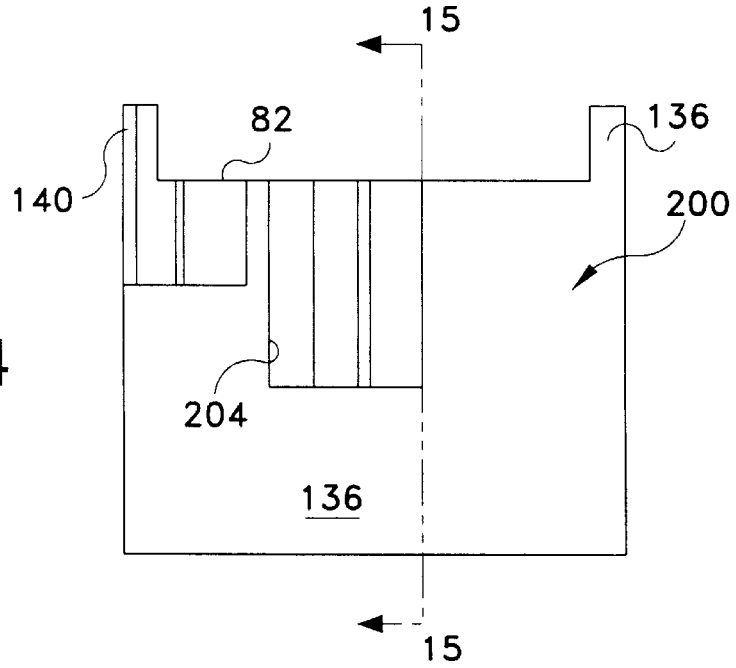
FIG. 14 is a top plan view of the rear sled of FIG. 12.
Figure 15:
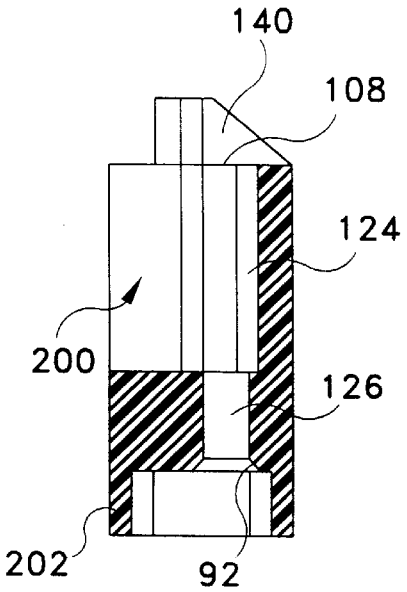
FIG. 15 is a side elevational view of a rear sled taken along line 15—15 of FIG. 14.
Figure 16:
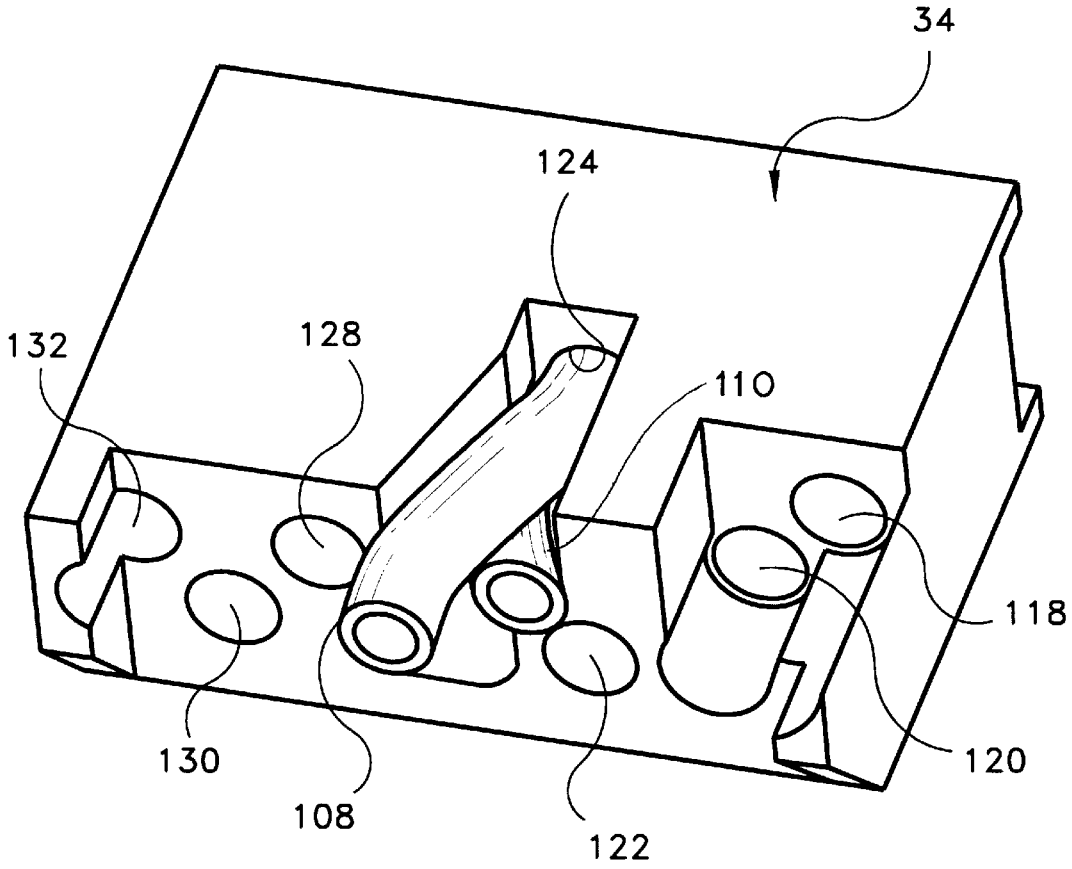
FIG. 16 is a front perspective view of the rear sled of FIG. 4, illustrating the crossover of two wires.

The plug connector 20 is formed by a kit comprising plug housing 22, insulation displacement contact 24, front sled 32 and rear sled 34. A portion of the outer sheath of cable 28 is removed to expose portions of the four twisted pairs of wires 30, each with their insulation 30*a* directly thereon still intact over their conductors 30*b*. The eight wires are then threaded through rear sled 34 with a crossover occurring in the two wires passing through conduits 124 and 126 as illustrated in FIG. 16. The eight wires are then passed through the first sled with the individual wires being located in the individual passages 78. The wires can be retained within the two sleds by adhesive. The two sled subassembly with the eight wires adhered and affixed therein is then inserted into plug housing until the front sled engages plug housing front wall 50 as illustrate in FIG. 11. The contacts 24 are then inserted into internal chamber 40, through front sled openings 80 and into the respective passages 78, to pass through the insulation around each wire and mechanically and electrically engage the conductor of each wire. This relatively simple operation completes the termination of the cable with the plug connector.

The length, spacing and relative locations of the conduits impact the balanced reactive coupling between connector positions 3 and 6 (i.e., conduits 122 and 128) and positions 4 and 5 (i.e., conduits 124 and 126). The spacing between the front and rear sleds controlled by tabs 138 and 140 also significantly impact the balanced reactive coupling across the connector. Forming the connector according to the present invention and controlling these factors the ensures compliance with the electrical and mechanical performance standards for Category 6 connectors.

The terminated open circuit this connector will perform at 41.5 dB±0.5 dB. The wire orientation device ensures that the termination open circuit performance remains both very constant and extremely reproducible. This performance is accomplished by grouping the wires into adjacent pairs through the wire holding device. The grouping reduces near end cross talk, improves return loss and holds impedance constant on the conductive pathway, making it possible to attain very specific performance levels across the interconnection device and enabling the performance across the entire conductive pathway to be held in a very narrow performance margin.

The rear sled holds the center-to-center spacing of adjacent wires such that the electromagnetic fields generated by each conductive pathway partially cancels each other. The electrical performance can be closely modified by altering the center-to-center spacing of the wires in the structure.

FIGS. 11–14 disclose a second embodiment of the rear sled 200. The rear sled differs from the rear sled of the first embodiment in that flanges 142 and 144 and the tapered transverse passage 134 of the first embodiment are replaced by a rectangular tubular extension 202 on the rear or outer end of the rear sled and a transverse passage 204 which is not tapered, respectively. Except for these two differences, the rear sleds of the first and second embodiments are identical, with the features thereof being identified with identical reference numerals.

The front and rear sleds can be formed of the two separate parts, can be connected or can be formed as a singe, unitary piece of plastic. With two separate parts, individual wires can be twisted between the two sleds to be oriented in different positions in the front and rear sleds. Such different orientation between the two sleds increases crosstalk cancellation between adjacent wire pairs. For a one piece configuration, the spacing between the two sleds is held constant.

The individual wires in the unshielded twisted pairs may be laminated or bonded with a separable membrane, prior to lacing in the structure. The lamination will hold the orientation of the wires in the necessary configuration which render the electrical performance. The lamination on the wires will make the termination process more efficient.

While various embodiments have been chosen to illustrate the invention, it will be understood by those skilled in the art that various changes and modification can be made therein without departing from the scope of the invention and defined in the appended claims.

What is claimed is:

1. A connector for communication systems, comprising:

a housing having front and rear ends, an internal chamber opening on said rear end and defined by housing walls, and a plurality of slots extending through one of said housing walls adjacent said front end;

a plurality of insulation displacement contacts mounted in said slots for movement between retracted positions spaced from said chamber and inserted positions extending into said chamber;

a front sled, located in said internal chamber adjacent said front end, having front sled walls defining axial passages therethrough, and lateral openings extending through one of said front sled walls into said axial passages and aligned with said slots and said contacts; and a rear sled, located in said internal chamber adjacent said rear end, having at least first, second, third and fourth entry ports on an outer end thereof arranged in a first ordered array, at least first, second, and third and fourth exit ports on an inner end thereof arranged in a second ordered array, and first, second, third and fourth conduits extending respectively between said entry and exits ports, said second and third conduits being laterally open into each other and being in relatively close proximity and crossing over each other between said entry and exit ports.

2. A connector according to claim 1 wherein said axial passages are substantively coplanar in said front sled.

3. A connector according to claim 1 wherein in said first ordered array, said second and third entry ports are between said first and fourth entry ports.

4. A connector according to claim 3 wherein in said second ordered array, said second and third exit ports are between said first and fourth exit ports.

5. A connector according to claim 1 wherein first, second, third and fourth wires, arranged in two twisted pairs in a cable, extend through said first, second, third and fourth entry ports, conduits and exit ports, respectively, and into said axial passages in said front sled;

whereby said wires are held in alignment for engagement by said contacts.

6. A connector according to claim 5 wherein said wires have lengths and widths and are relatively spaced such that induced crosstalk is approximately cancelled.

7. A connector according to claim 5 wherein said first and fourth wires form a first twisted pair in said cable; and said second and third wires form a second twisted pair in said cable.

8. A connector according to claim 5 wherein said first and fourth wires are coupled to sources of equal and opposite signals.

9. A connector according to claim 8 wherein said second and third wires are coupled to sources of equal and opposite signals.

10. A connector according to claim 1 wherein said entry ports are arranged in first and second parallel, vertically spaced rows.

11. A connector according to claim 10 wherein said first and third entry ports are in said first row and;

said second and fourth entry ports are in said second row.

12. A connector according to claim 11 wherein a transverse passage extents through said rear sled into and joining said second and third conduits.

13. A connector according to claim 12 wherein said transverse passage tapers in a direction from said exit ports toward said entry ports.

14. A connector according to claim 12 wherein said transverse passage opens on said inner end and a lateral side of said rear sled.

15. A kit for making a communication system connector, comprising:

a housing having front and rear ends, an internal chamber opening on said rear end and defined by housing walls, and a plurality of slots extending through one of said housing walls adjacent said front end;

a plurality of insulation displacement contacts adapted to be mounted in said slots for movement between retracted positions spaced from said chamber and inserted positions extending into said chamber;

a front sled, adapted to be located in said internal chamber adjacent said front end, having front sled walls defining axial passages therethrough, and lateral openings extending through one of said front sled walls into said axial passages and alignable with said slots and said contacts; and a rear sled, adapted to be located in said internal chamber adjacent said rear end, having at least first, second, third and fourth entry ports on an outer end thereof arranged in a first ordered array, at least first, second, and third and fourth exit ports on an inner end thereof arranged in a second ordered array, and first, second, third and fourth conduits extending respectively between said entry and exit ports, said second and third conduits being laterally open into each other and being in relatively close proximity and crossing over each other between said entry and exit ports.

16. A kit according to claim 15 wherein said axial passages are substantially coplanar in said front sled.

17. A kit according to claim 15 wherein in said first ordered array, said second and third entry ports are between said first and fourth entry ports.

18. A kit according to claim 17 wherein in said second ordered array, said second and third ports are between said first and fourth exit ports.

19. A kit according to claim 15 wherein said entry ports are arranged in first and second parallel, vertically spaced rows.

20. A kit according to claim 19 wherein said first and third entry ports are in said first row; and said second and fourth entry ports are in said second row.

21. A kit according to claim 20 wherein a transverse passage extends through said rear sled into and joining said second and third conduits.

22. A kit according to claim 21 wherein said transverse passage tapers in a direction from said exit ports toward said entry ports.

23. A kit according to claim 21 wherein said transverse passage opens on said inner end and a lateral side of said rear sled.

24. A connector for communication systems, comprising:

a housing having front and rear ends, an internal chamber opening on said rear end and defined by housing walls, and a plurality of slots extending through one of said housing walls adjacent said front end;

a plurality of insulation displacement contacts mounted in said slots for movement between retracted positions spaced from said chamber and inserted positions extending into said chamber;

a front sled, located in said internal chamber adjacent said front end, having front sled walls defining substantially coplanar axial passages therethrough, and lateral openings extending through one of said front sled walls into said axial passages and aligned with said slots and said contacts; and a rear sled, located in said internal chamber adjacent said rear end, having at least first, second, third and fourth entry ports on an outer end thereof arranged in a first ordered array with said second and third entry ports being between said first and fourth entry ports, at least first, second, and third and fourth exit ports on an inner end thereof arranged in a second ordered array with said second and third exit ports being between said first and fourth exit ports, and first, second, third and fourth conduits extending respectively between said entry and exits ports, said second and third conduits being laterally open into each other and being in relatively close proximity and crossing over each other between said entry and exit ports, said first and third entry ports being in a first row, said second and fourth entry ports being in a second row parallel and to and spaced vertically from said first row, a transverse passage extending through said rear sled into and joining said second and third conduits, tapering in a direction from said exit ports toward said entry ports and opening said inner end and a lateral side of said rear sled; and first, second, third and fourth wires, arranged in two twisted pairs in a cable, with said first and fourth wires forming a first twisted pair and said second and third wires forming a second twisted pair, extending through said first, second, third and fourth entry ports, conduits and exit ports, respectively, and into said axial passages in said front sled, said wires having lengths and widths and being relatively spaced such that induced is approximately cancelled;

whereby said wires are held in alignment for engagement by said contacts.

25. A connector according to claim 24 wherein said first and fourth wires are coupled to sources of equal and opposite signals; and said second and third wires are coupled to sources of equal and opposite signals.

* * * * *